US011725407B2

(12) United States Patent
Schmidt

(10) Patent No.: US 11,725,407 B2
(45) Date of Patent: Aug. 15, 2023

(54) POOL SKIMMER DEVICES, SYSTEMS, AND METHODS

(71) Applicant: Robert Douglas Schmidt, San Diego, CA (US)

(72) Inventor: Robert Douglas Schmidt, San Diego, CA (US)

( * ) Notice: Subject to any disclaimer, the term of this patent is extended or adjusted under 35 U.S.C. 154(b) by 0 days.

(21) Appl. No.: 17/443,155

(22) Filed: Jul. 21, 2021

(65) Prior Publication Data

US 2022/0025668 A1 Jan. 27, 2022

Related U.S. Application Data

(60) Provisional application No. 63/054,632, filed on Jul. 21, 2020.

(51) Int. Cl.
*E04H 4/12* (2006.01)

(52) U.S. Cl.
CPC ..... *E04H 4/1272* (2013.01)

(58) Field of Classification Search
CPC ..... E04H 4/1272
USPC ..... 210/167.1, 167.12, 167.19, 167.2, 232, 210/416.1, 416.2
See application file for complete search history.

(56) References Cited

U.S. PATENT DOCUMENTS 3,567,020 A 3/1971 Whitaker
3,616,916 A 11/1971 Greene
4,212,740 A 7/1980 Greene
4,325,150 A * 4/1982 Buddy ..... E04H 4/1272 D23/209
5,133,854 A 7/1992 Horvath
5,581,826 A * 12/1996 Edwards ..... E04H 4/1645 4/507
5,830,350 A 11/1998 Voss
6,224,753 B1 5/2001 Marbach
6,709,582 B2 3/2004 Danner
7,727,387 B2 6/2010 Goggin
8,721,881 B1 5/2014 Smith
8,728,307 B2 5/2014 Iacovacci
9,581,478 B1 2/2017 Smith
9,879,439 B2 1/2018 Norberto, III
9,945,139 B2 4/2018 Noberto, III et al.
10,260,247 B2 4/2019 Noberto, III et al.
2007/0163933 A1 7/2007 Goggin
2014/0202941 A1 7/2014 Iacovacci
2014/0209546 A1 7/2014 Smith
2015/0247332 A1 9/2015 Norberto, III

* cited by examiner

*Primary Examiner* — Fred Prince

(74) *Attorney, Agent, or Firm* — Knobbe Martens Olson & Bear LLP

(57) ABSTRACT

A pool skimmer device includes float harness that is attached to a cylindrical shaped device, which includes a self-adjusting funnel positioned at the distal end of the extension body, the funnel having a wide opening positioned at the distal end of the extension body and a narrow opening, and a funnel profile extending between the wide opening and the narrow opening, a coarse skimmer basket, a ballast collar and an outlet to the pool's filtration system, in which the outlet can be replaced with a submersible water pump and filter.

10 Claims, 9 Drawing Sheets

POOL SKIMMER DEVICES, SYSTEMS, AND METHODS

INCORPORATION BY REFERENCE TO ANY PRIORITY APPLICATIONS

This application claims priority to U.S. Provisional Patent Application No. 63/054,632, filed Jul. 21, 2020, and which is incorporated herein by reference. U.S. patent application Ser. No. 16/516,021, filed Jul. 18, 2019, and U.S. patent application Ser. No. 16/983,508, filed Aug. 3, 2020, are also incorporated herein by reference. Any and all applications for which a foreign or domestic priority claim is identified in the Application Data Sheet as filed with the present application are hereby incorporated by reference under 37 CFR 1.57.

BACKGROUND

Field

This application relates to pool skimmer devices, systems, and methods.

Description

Swimming pools are enjoyed by many for leisure and exercise in both private and public settings. To provide healthy conditions and maximum enjoyment, it is important to ensure that water within a swimming pool remains clean, clear, and free from debris. For this reason, swimming pools generally include circulation and filtration systems that are designed to clean the water.

Many swimming pools accumulate unwanted debris, such as leaves, pollen, seeds, insects, etc., on the surface of the water. Commonly, existing circulation and filtration systems may be ineffective at removing this debris from the water's surface. Accordingly, pool owners frequently and undesirably are required to manually capture and remove debris from the water's surface using a pool skimmer net.

Oil spills in water, such as oceans, seas and lakes, also gather oil on the surface of the water. In addition, many micro-plastics and small plastic particles float on the surface of water. Much of these contaminants are difficult to remove and have large environmental and economic impacts.

SUMMARY

In a first aspect, a pool skimmer device is disclosed. The device includes a float harness with floats that are allowed to be vertically positioned, and a funnel positioned at the distal end of the extension body, the funnel comprising a wide opening positioned at the distal end of the extension body and a narrow opening, and a funnel profile extending between the wide opening and the narrow opening, and a coarse basket axial centered beneath the funnel assembly, and a ballast collar centered on the vertical axis, and an exhaust outlet.

The device can include one or more of the following features in any combination: (a) wherein the height of the funnel is self-determined and positions itself to float just beneath the surface of the water, which is 0 to 3 inches in depth; (b) wherein the floats on the harness can be positioned to allow the funnel to be positioned vertically on the funnel assembly to allow maximum movement up and down below the surface of the water; (c) wherein the coarse basket filters coarse debris from the water; (d) wherein the ballast collar keeps the entire device vertically positioned in the water and the floats fully against the float stops and the device bottom at a persistent depth; (e) wherein the floats, ballast, and self-adjusting funnel work together to keep the wide funnel opening at a depth just beneath the surface of the water, which is 0 to 3 inches, and the funnel optimally vertically positioned on the funnel assembly, which allows for the funnel to constantly adjust in non-smooth water surfaces, such as swells, wind-chop, or rough water; (f) wherein the bottom outlet (exhaust) allows water to be pulled through the device; (f) wherein the bottom outlet (exhaust) can be connected to a swimming pool vacuum port or skimmer suction opening so the swimming pool filter and pump can pull water through the device and filter the water, which will be returned to the pool in the normal fashion; (h) wherein an optional water pump can replace the bottom outlet (exhaust) pipe, so that water can be pumped through the device at various rates, such as 4000 gallons per hour, if, for example, a Johnson 4000 bilge pump is used; (i) wherein the optionally attached water pump can pump the water into a filter, such as a 50, 100, 200 micron water filter bag, which can have a four or six inch opening, but not limited to these openings or micron ratings; (j) wherein a filter bag plate can be designed to connect the filter bag to the device through a standard pool vacuum hose; and/or other features as described throughout the application.

BRIEF DESCRIPTION OF THE DRAWINGS

The features and advantages of the pool skimmer device, systems, and methods described herein will become more fully apparent from the following description and appended claims, taken in conjunction with the accompanying drawings. These drawings depict only several embodiments in accordance with the disclosure and are not to be considered limiting of its scope. In the drawings, similar reference numbers or symbols typically identify similar components unless context dictates otherwise. The drawings may not be to scale.

DETAILED DESCRIPTION

This application relates to devices, systems, and methods that are configured to clean a pool, such as a swimming pool. The devices, systems, and methods may be configured, in particular, to clean debris, such as pollen, insects, seeds, leaves, etc., from the surface of the water in a pool. As will be described in greater detail below, the devices, systems, and methods may be configured to use the surface tension of the water to pull in debris from the surface of the water.

Figure 2:
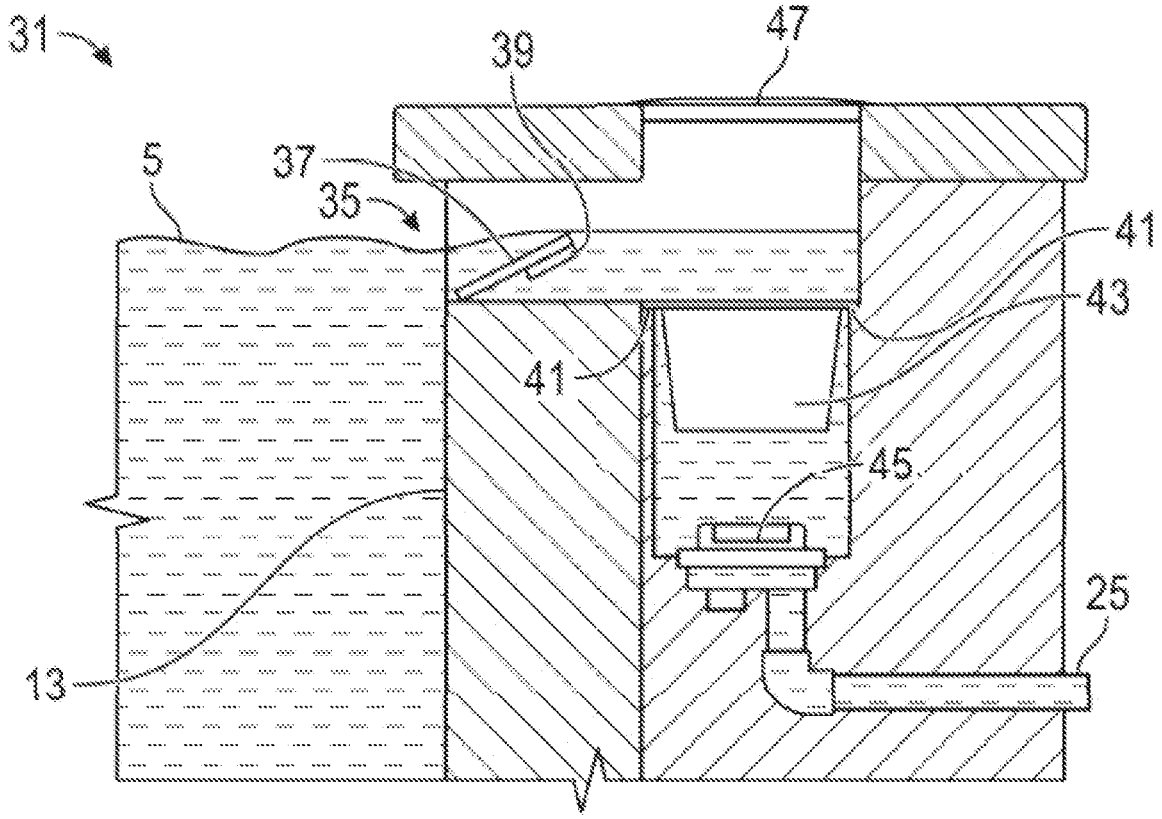
FIG. 2 is a cross-sectional view of an embodiment of a pool skimmer.

Generally, swimming pools include pool skimmers in an effort to clear the surface of the water from debris. An example of such a skimmer is shown in FIG. 2 described below. These skimmers, however, do not work effectively, often failing to sufficiently clean the surface of the pool of debris. For example, with such a skimmer, even after the debris has entered the skimmer, it may not be sucked into the filter. This can be particularly true for smaller debris (such as pollen, small insects, seeds, etc.) as these types of debris float and do not saturate. Further, debris trapped in the skimmer may float out of the skimmer and back into the pool after the filter is powered off. Again, this can be particularly true for small debris which can often float over or around the pool skimmer's weir door.

The following discussion presents detailed descriptions of the several embodiments of the pool skimmer devices, systems, and methods shown in the figures. These embodiments are not intended to be limiting, and modifications, variations, combinations, etc., are possible and within the scope of this disclosure. As will be discussed in more detail below, these pool skimmer devices, systems, and methods can be used to efficiently and effectively clean the surface of a pool.

Figure 1:
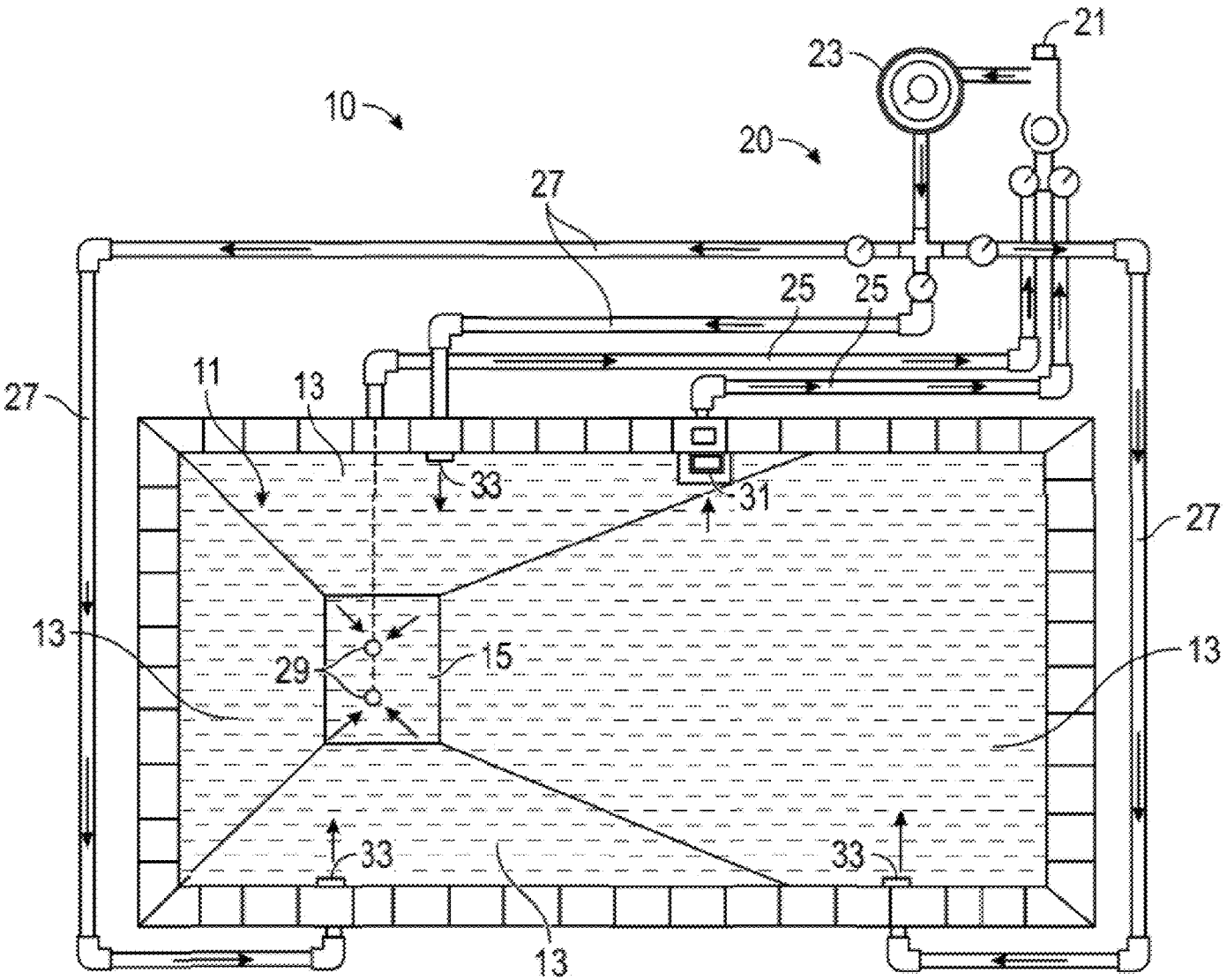
FIG. 1 is a schematic illustration of an embodiment of a pool system.

FIG. 1 is a schematic illustration of an embodiment of a pool system 10. As illustrated, the pool system 10 includes a pool 11 and a circulation and filtration system 20. The pool system 10 may be representative of an outdoor pool system, an indoor pool system, an inground pool system, an above ground pool system, or any other type of pool system. The pool 11 of the pool system 10 can include freshwater or saltwater. The pool 11 of the pool system 10 includes sidewalls 13 and the bottom surface 15 that contain the water of the pool 11. Although illustrated with a generally rectangular shape, the pool 11 can be formed with any suitable shape as desired.

The pool system 10 includes a circulation and filtration system 20 configured to circulate and clean the water of the pool 11. Various types of circulation and filtration systems 20 can be used. As illustrated, the circulation and filtration system 20 includes a water pump 21 that circulates water from the pool 11 through various suction lines 25 and return lines 27. The water pump 21 also circulates the pool water through a filter 23.

Example flow of water through the circulation and filtration system 20 of the pool system 10 will now be described with reference to FIG. 1. As illustrated, the pool system 10 includes two main drains 29 positioned in the bottom surface 15 of the pool 11. The water pump 21 pulls water from the pool 11 through the main drains 29 and corresponding suction lines 25.

The pool system 10 also includes a pool skimmer 31. The pool skimmer 31 can be positioned in a sidewall 13 of the pool 11. An example pool skimmer 31 is shown in greater detail in the cross-sectional side view of FIG. 2, which is described in more detail below. As shown in FIGS. 1 and 2, the pool skimmer 31 is positioned in the sidewall 13 of the pool 11 near the water line of the water in the pool 11. The water pump 21 also pulls water from the pool 11 through the pool skimmer 31 and the corresponding suction line 25. The water pump 21 then pumps the water in the suction lines 25 through the filter 23. After passing through the filter 23, the water pump 21 moves the water through return lines 27. In the illustrated embodiment the pool system 10 includes three returns 33 through which the water is returned to the pool 11.

The pool skimmer 31 attempts to clean the surface of the water of the pool 11 as the pump 23 pulls water through the pool skimmer 31. The conventional process by which the pool skimmer 31 will be described with reference to FIG. 2.

FIG. 2 is a cross-sectional view of an embodiment of the pool skimmer 31 of the pool system 10 of FIG. 1. As shown, the pool skimmer 31 includes an aperture 35 formed in the sidewall 13 of pool 11. The aperture 35 is generally provided at the surface 5 of the water in the pool at 11. The aperture 5 may be generally rectangular, although other shapes are possible. The aperture 35 may be formed in the coping of the sidewall 13 of the pool 11. The aperture 35 allows water from the surface 5 of the pool 11 (for example, the top 0 to 5 inches of water) to enter into the pool skimmer 31 through the aperture 35.

The pool skimmer 31 can include a weir door 37 configured to close the aperture 35. The weir door 37 can comprise a hinged door and a float 39. The float 39 is configured to raise the weir door 37 to close the aperture 35 (for example, such that the top of the weir door 37 is positioned at the surface 5 of the water). When the pump 21 (FIG. 1) is active, the pull of water through the pump 21 may cause water from the pool 11 to flow over the weir door 37 and into the pool skimmer 31.

Figure 3:
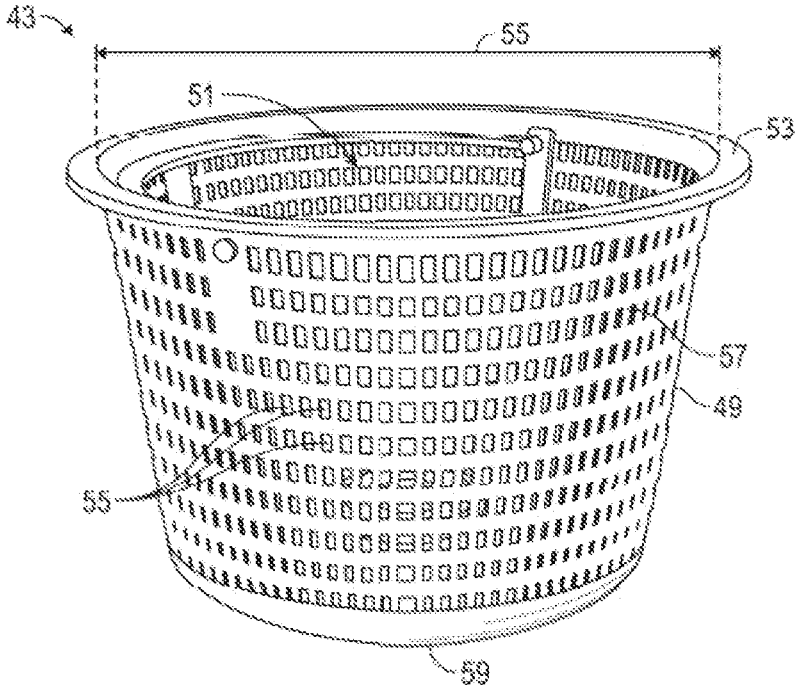
FIG. 3 is a perspective view of an embodiment of a skimmer basket.

Within the pool skimmer 31, the pool skimmer includes a skimmer basket 43. The skimmer basket 43 can be supported by a ledge 41 or other supporting structure within the pool skimmer 31. An example skimmer basket 43 is shown in FIG. 3, which is described in more detail below. The skimmer basket 43 is generally configured to serve as a filter or strainer (for example, including perforated openings or mesh) configured to prevent debris (e.g., debris larger than the perforated openings) from being sucked through pool skimmer 31 and into the water pump 21.

Below the skimmer basket 43, the pool skimmer 31 can, in some embodiments, include a float valve 45. The float valve 45 can be configured as a safety device for the water pump 21. If the water gets low in the pool 11, a float inside the float valve 45 can fall down to shut off the pool skimmer 31 such that the water pump 21 only pulls water from the main drains 29 of the pool 11. This can prevent damage to the water pump 21 caused by running the pump dry. In some embodiments, a pool system 10 can have the line to the bottom filter capped. However, there are many installations where this opening is not capped, and a pipe extends to the bottom filter opening. In these configurations, the float valve 45 is available.

FIG. 2 further illustrates a portion of the suction line 25 that connects the pool skimmer 31 to the water pump 21. In use, the water pump 21 pulls water over the weir door 37 and into the pool skimmer 31. The water is then pulled down through the skimmer basket 43, which strains larger debris from passing therethrough. The water is then pulled through the float valve 45 (if installed) and suction line 25 to the water pump 21. Large debris may be caught within the skimmer basket 43. Some small debris may also become saturated and enter the skimmer basket 43. When the water pump 21 is disengaged, however, much of the debris in the skimmer basket 43 is free to float back up to the surface 5 of the water and join small debris that is already floating above the skimmer basket 43. In some instances, the floating debris is able to float over or around the weir door 37, through the aperture 35, and back into the pool 11. Thus, a pool skimmer 31 as shown in FIG. 2 can be inefficient at cleaning the surface 5 of the water, leading many pool owners to run their filtration and circulation systems at high power and/or for an extended duration in an effort to get small floating debris to actually submerge and enter the suction line 25 to the filter 23.

Another problem with pool skimmers 31 such as shown in FIG. 2 is that they are often only able to trap and remove debris from the surface 5 of the pool water when the debris moves close to the aperture 35 of the pool skimmer 31 so as to be sucked into the skimmer basket 43. This can leave a large portion the pool surface uncleaned. The pool skimmer 31 has no mechanism for pulling the surface 5 of the water into the pool skimmer 31.

FIG. 3 is a perspective view of an embodiment of the skimmer basket 43 of the pool skimmer 31 of FIG. 2. In the illustrated embodiment, the skimmer basket 43 includes a main body 49. As shown, the main body 49 of the skimmer basket 43 comprises a tapered cylindrical or frustoconical shape. Other shapes for the main body 49 of the skimmer basket 43 are also possible, such as fully cylindrical or even rectangular. In FIG. 3, the main body 49 of the skimmer basket 43 comprises side walls 49 and bottom wall 59. The skimmer basket 43 also comprises an upper opening 51 surrounded by a rim 53.

The upper opening 51 provides an entrance into the skimmer basket 43. The upper opening 51 can have a diameter 55 as shown. Various pool supply manufacturers provide different types of skimmer baskets 43 for different types of pool skimmers 31. Accordingly, the diameter 55 of the upper opening 51 may be different depending on the specific embodiment of the skimmer basket 53. Although the upper opening 51 is described as having a diameter 55, in some embodiments, the skimmer basket 43 (and in particular the upper opening 51) may be non-circular (e.g., square or rectangular). The rim 53 can be configured to engage with the ledge 41 of the pool skimmer 31 (FIG. 2) to support the skimmer basket 41 within the pool skimmer 31.

Additionally, as illustrated, the main body 49 of the skimmer basket 43 (e.g., the sidewalls 57 and or bottom wall 59 can include a plurality of apertures 55 (such as perforations or openings) configured to provide straining functionality for the skimmer basket 43. The size of the apertures 55 can vary depending on the specific embodiment. In some embodiments, the apertures 55 can be replaced with or include a mesh.

Figure 6:
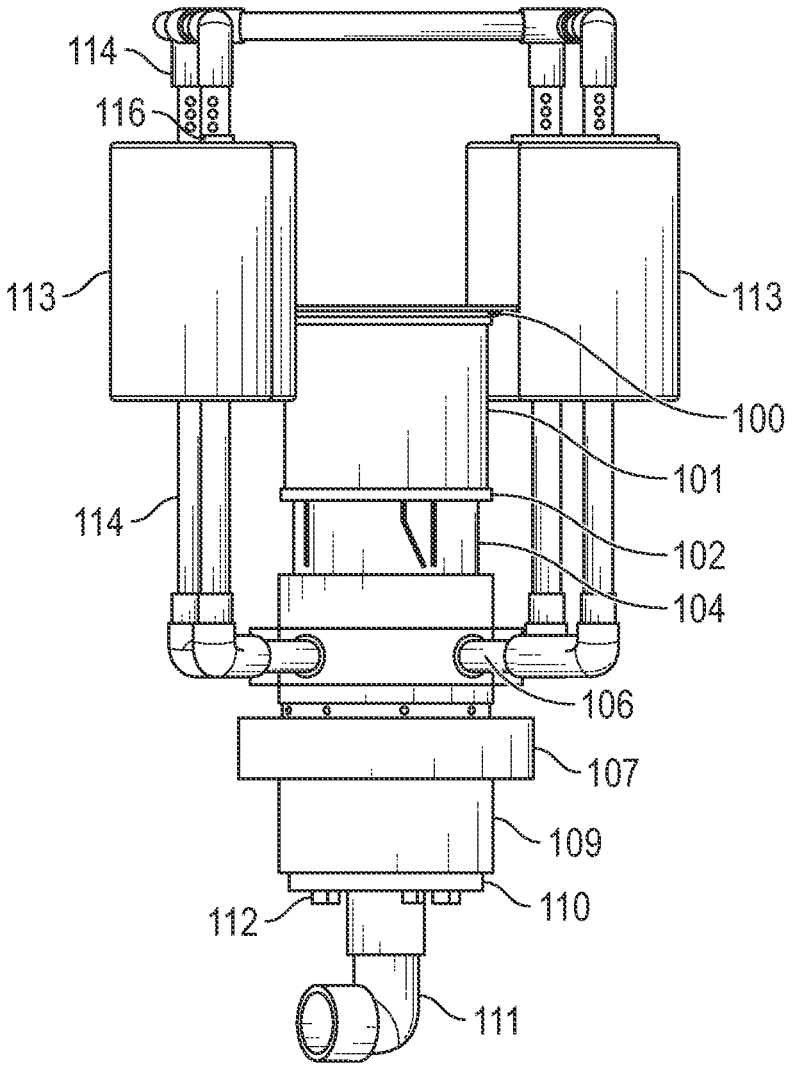
FIG. 6 is an illustration of an embodiment of the skimmer device in a body of water. In this example, the funnel is self-positioned just beneath the water surface and the surface water is falling into the funnel opening.
Figure 12:
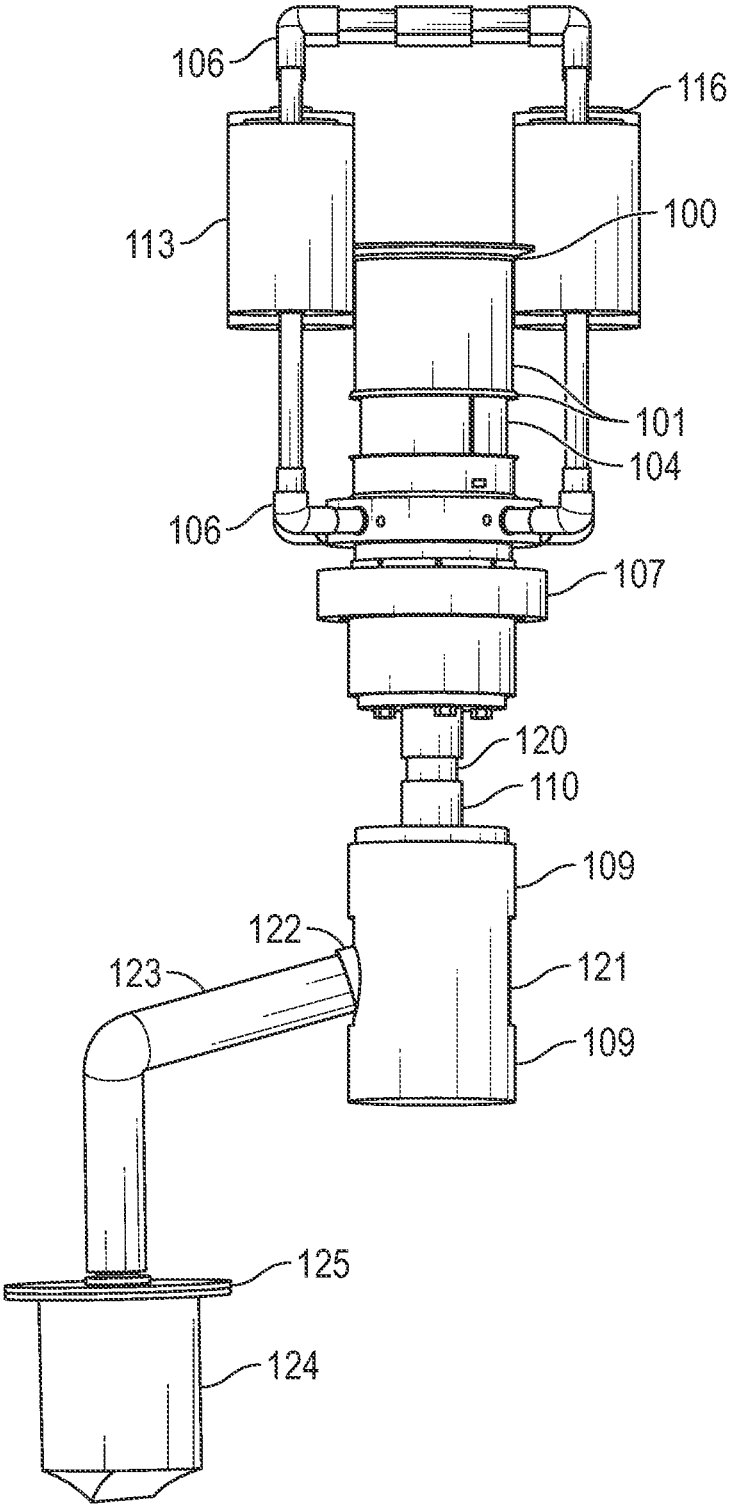
FIG. 12 is a view of an embodiment of the skimmer device with the optional water pump attachment that replaces the outlet (exhaust). Also shown is the optional filter bag attached by a standard pool vacuum hose and hose adapter plate to allow the attachment.

FIG. 12 illustrate views and various components of embodiments of a skimmer device (also referred to simply as a skimmer) that can be used to clean the surface water in a pool and rid it of debris, such as bugs, dust, seeds, small leaves, and other unwanted debris. The skimmer can be used to replace the pool skimmer 31 of FIGS. 1 and 2. The skimmer devices can include a funnel shaped opening that allows water to enter the filter suction pipe through a large diameter opening that tapers to a smaller diameter opening. The skimmer devices have a funnel shaped opening that self-position just below the surface of the water, which can induce flow through the devices. Water from the surface of the pool can simply fall and follow the funnel shape into the skimmer (as shown in FIG. 6).

The skimmer device can be configured to attach to conventional skimmers (FIG. 2), by attaching a standard pool vacuum hose to the outlet of the skimmer device, and then attaching the other end of the vacuum hose through the skimmer opening 35 (FIG. 2) to the suction pipe 25 opening at the bottom on the skimmer 31. The wide opening of the funnel of the skimmer can allow water to enter the funnel shape into a lower smaller opening, and then into the coarse skimmer basket 103 (FIGS. 4 & 5) within the device. With this configuration, water containing small surface debris will be filtered by the swimming pool's normal filtration unit 23 and is the device is powered by the pool's pump 21.

The skimmer device can be configured independently of the swimming pool's filtration system by attaching the optional water pump and filter assembly to the device (FIG. 12). The water pump will pull water through the funnel opening at the top of the device and through the device, and then exhaust the water into a filter assembly, such as a filter bag. This configuration allows the device to freely float within the body of water.

The skimmer devices self-position the larger opening of the funnel at a depth just below the surface of the water in the pool. When the opening of the funnel is beneath the surface, the water level in the skimmer device may be lower than the water level in the pool. This causes the water to follow the shape of the funnel into the lower part of the funnel and into the basket below.

Floating debris in pool water is trapped within the surface tension of the water. As will become more fully apparent from the following description, when water enters the funnel of the skimmer device, the surface will warp and be pulled into the wide opening, through the narrow opening, and through the attached debris catching coarse skimmer basket. Along with pulling the surface water into the skimmer, all or much of the small floating debris, such as pollen, dust, bugs, small leaves, pieces of deteriorating thermo-pool covers, etc., will also be pulled into the skimmer. The debris that is not trapped in the coarse skimmer basket will also be sucked into the pool filter or the attached filter bag assembly, assuming it is sufficiently small so as to pass through the coarse skimmer basket.

Further, since the debris can be mixed into the water as it flows through the funnel of the skimmer device, it can be temporarily less buoyant and more easily sucked into the filter. The turbulence within the skimmer device helps to force the debris particles through the bottom of the basket. These and other features of the skimmer devices described herein will become more fully apparent from the descriptions of the nonlimiting examples of FIG. 12.

Figure 4:
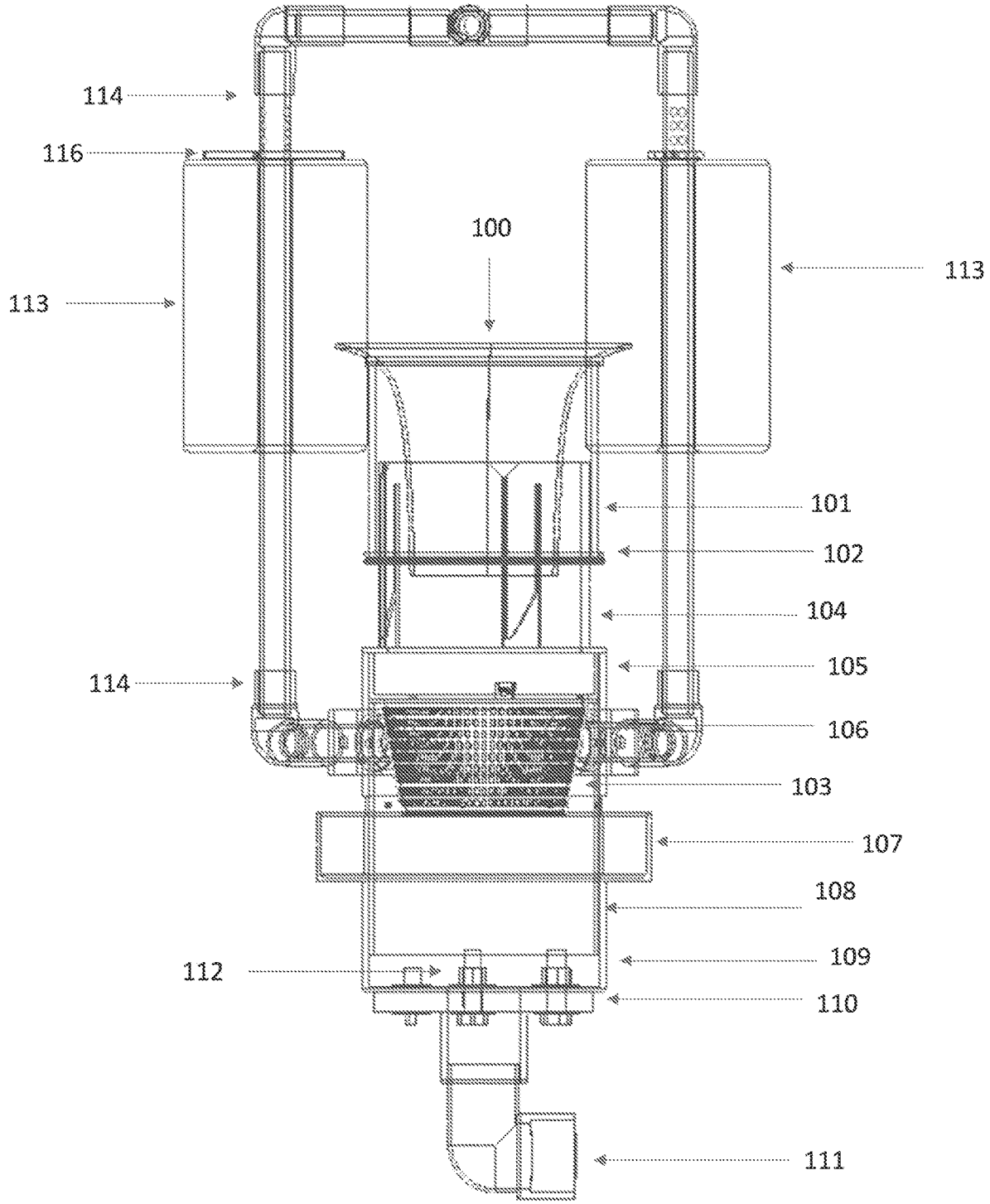
FIG. 4 is a cross-sectional view of an embodiment the skimmer device. The floats are against the float stops and the funnel is positioned vertically on the funnel assembly, which is how the device may be configured when placed and functioning within a body of water.
Figure 5:
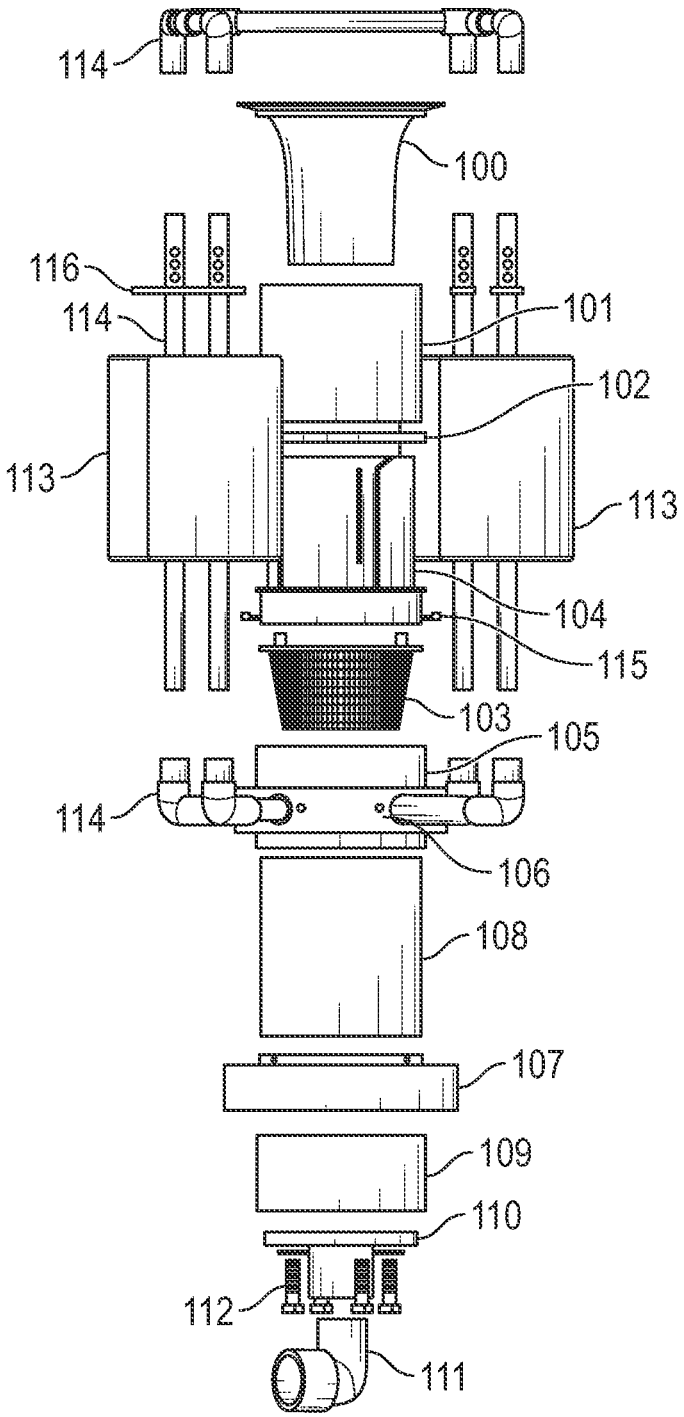
FIG. 5 is an exploded view of an embodiment of the skimmer device, which shows how the parts are aligned axially along the vertical axis.

FIG. 4 is a wire frame half section view and FIG. 5 is an exploded view of the skimmer device that will attach to the pool via a vacuum hose with one end attached to the device though outlet (exhaust) port 111 to the pool's vacuum port or through the pool's skimmer 31.

In the illustrated embodiment, the skimmer has a float harness 114 that may attach to the device via the float harness collar 106. The float harness 114, has floats 113 that are allowed to freely vertically float, but the height has a ceiling defined by the float stops 116. The purpose of the float harness is to allow the entire device to be suspended in the water at a depth that will allow the self-adjusting height of the funnel 100 to place the funnel at an optimal height on the funnel basket holder 104 funnel assembly.

Figure 9:
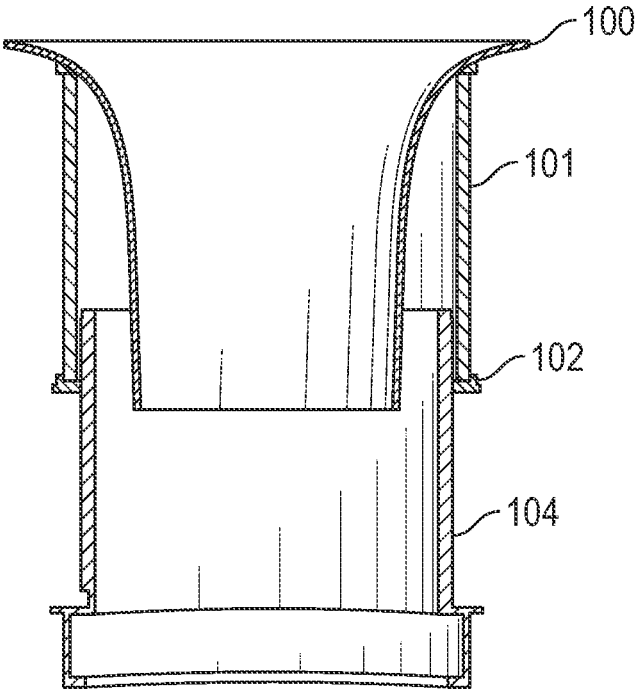
FIG. 9 is a cross-sectional view of an embodiment of the skimmer funnel assembly. In the illustrated configuration, the funnel is fully extended.
Figure 10:
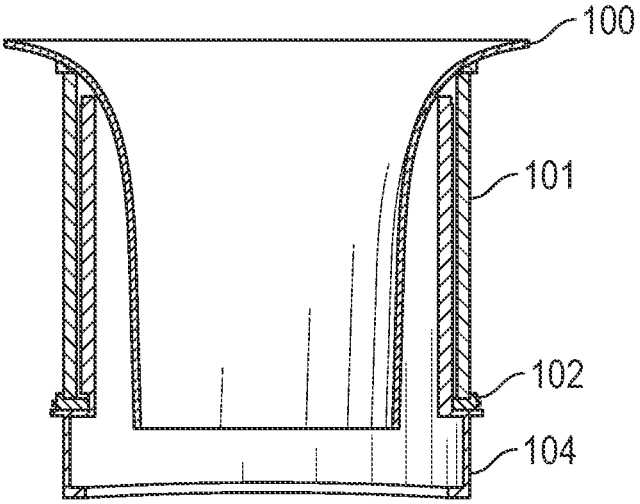
FIG. 10 is a cross-sectional view of an embodiment of the skimmer funnel assembly. In the illustrated configuration, the funnel is at its lowest position.

In the illustrated embodiment, the skimmer device, which can also be seen in FIGS. 9 and 10, comprises of a funnel 100, a funnel sleeve 101, and a funnel ring 102. The shape of the funnel, which follows the path created by the formula $-1/x$, but not limited to this definition, allows for water to fall into the funnel opening, down to the water level within the device, which can be at the bottom of the funnel. The funnel sleeve 101 traps air in the funnel, which causes the funnel to float at some point between the water level in the pool and the water level within the device. The larger the difference between the pool water level and the water level within the device, then the greater the turbulence caused within the device. The funnel sleeve 101 also allows the funnel to smoothly travel up and down the shaft of the funnel basket holder 104. The funnel ring 102, allows the seal to the funnel basket holder 104 to have less friction then if the sleeve were of closer tolerance. The funnel ring 102 also may contain tabs that ride in grooves on the funnel basket holder 104. These tabs allow the funnel 100 to be locked onto the funnel basket holder 104. Therefore, the funnel 100 can freely vertically float on the funnel basket holder 104 but cannot float off the funnel basket holder 104.

The skimmer device optimally functions when the funnel 100 is positioned just beneath the surface of the water (0 to three inches). The floats 113, self-adjusting funnel 100, and the ballast collar 107 work together to ensure that the funnel 100 is properly positioning itself. In much the same way that a sailboat floats and has thousands of pounds of ballast to keep the boat upright and in the water, the ballast and floats function on the skimmer. When the skimmer is functioning the water level in the device should be lower than the water level in the pool. This causes the skimmer device to want to float, and if there were no ballast, then the device would float and keel over in the water, which will cause the device to fill with air and stop functioning. The ballast collar 107 disallows to skimmer device from floating up and keeling over, even when the device has taken on air. The floats 113 prevent the ballast collar 107 from pulling the entire device under the water. Therefore, the waterline of the device will be somewhere between the top and bottom of the floats 113.

The skimmer has two different water lines: 1. When the skimmer device is not functioning there is less air in the device and therefore more of it will be submerged and it will have a waterline closer to the top of the floats 113. 2. When the device is functioning there is more air in the device, and therefore less of it will be submerged and the waterline will be closer to the bottom of the floats 113.

Figure 8:
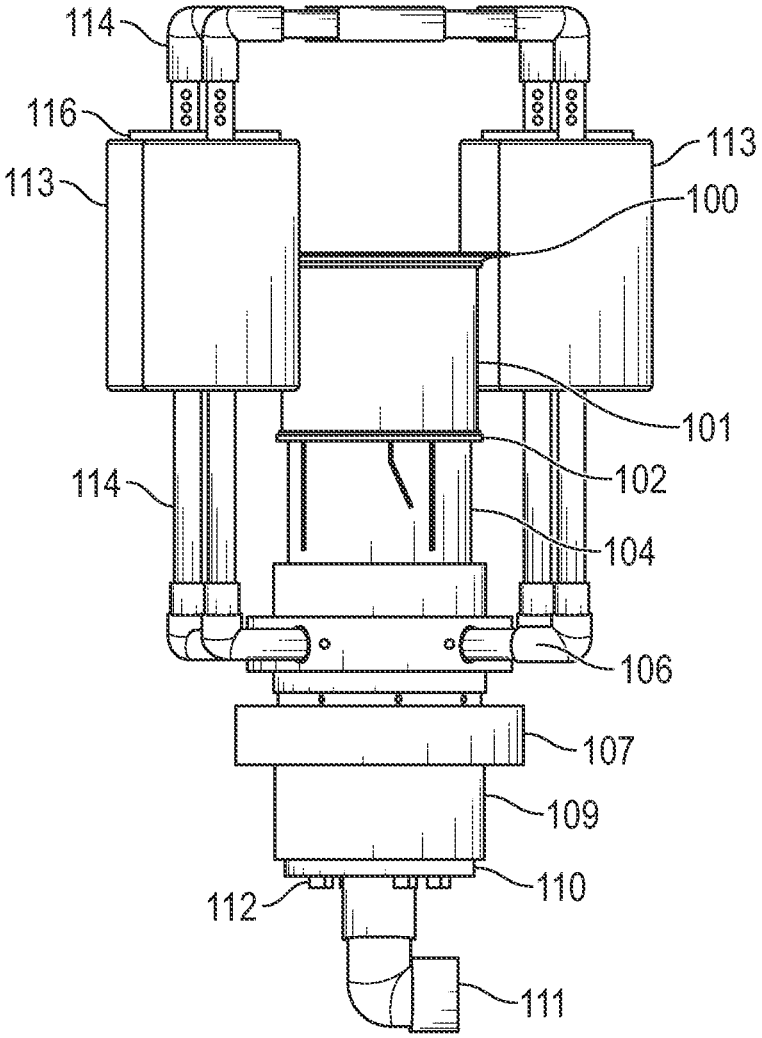
FIG. 8 is an illustration of an embodiment of the skimmer device in a body of water. In this example, the funnel opening is self-positioned above the water surface to keep trapped debris from leaving the device when it is not functioning.

When the skimmer device is functioning, the optimal position of the large opening of funnel 100 is just beneath the water line of the skimmer device, where it can accept the largest amount of surface water (FIG. 6). When the skimmer device is not functioning, the optimal position of the large opening of funnel 100 is above the water line of the skimmer device, so none of the larger debris that is still contained in the coarse basket 103 can float out of the device (FIG. 8).

When the skimmer device is functioning and the funnel is just beneath the water line of the device, which is the water line of the swimming pool, disturbances on the water surface, such as swells, wind chop, and splashing can cause the funnel 100 to rapidly change vertical position to adjust for the quickly varying water levels. The skimmer device can be configured to adapt to varying water levels using two methods: (1) The floats will naturally try to maintain constant depth, but will have damped oscillations while adapting, which will cause the entire device to raise up and down in the water, but not at the same rate as the turbulence itself, and (2) the funnel will try to position itself just under the surface of the water. So, the skimmer device itself is raising and lowering in the water and the funnel 100 is raising and lowering on the funnel basket holder 104, these variations can cause the funnel to quickly adjust in turbulent conditions. Therefore, there are float stops 116 that allow the floats to be positioned so that the funnel 100 can be optimally vertically placed on the funnel basket holder 104. By optimally, we mean with enough room to travel up and down the funnel basket holder 104 without violently crashing into the groove blocks and breaking the funnel ring 102 tabs off.

The floats 113 are be positioned high enough to allow the skimmer device to be low enough in the water to allow funnel 100 to position itself low enough in the water to be just beneath the water line. The lower the device the lower the funnel can travel. The floats 113 are positioned low enough to allow the funnel 100 to position itself above the water line when the device is not functioning, so that any debris in the device does not float out of the device. In smooth water, the variation of the distance that the funnel 100 travels is low and the length of the funnel basket holder 104 can be relatively short. In rough water, the variation of the distance that the funnel 100 travels is high and the length of the funnel basket holder 104 should be relatively long. In either case, the floats 113 should be used to properly place the funnel 100 midway on the funnel basket holder 104 when the device is functioning, but in such a position that the funnel can raise out of the water when the device is not functioning, as depicted in FIG. 8.

FIG. 6 is an illustration of the skimmer device functioning at the proper depth. The waterline of the device is between the top and bottom of the floats 113 and the funnel 100 is positioned just beneath the surface of the water. Also noticed that the funnel 100 has room to travel lower on the funnel basket holder 104, if needed. If a wave was to come and lift the device 100, then the funnel 100 will travel down the funnel basket holder 104 to compensate and keep itself just below the surface of the water. If the wave were to push the entire device lower into the water, then the funnel 100 will travel up the funnel basket holder 104 to compensate. This is how the floats 113, ballast 107 and funnel 100 all work together to keep the funnel position just below the surface of the water.

Figure 7:
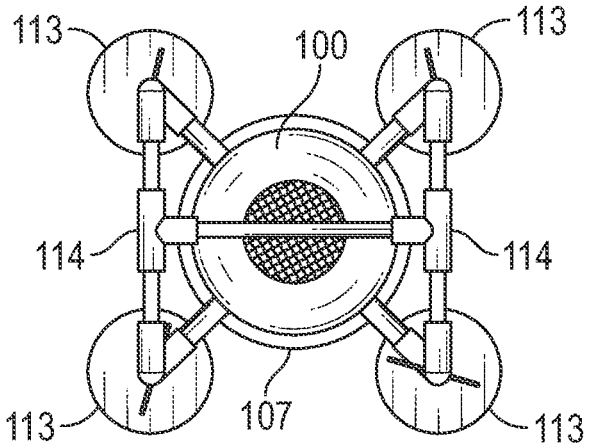
FIG. 7 is a top view of an embodiment of the skimmer device, which shows the floats fashioned radially around the device. In this example, the funnel opening can also be seen centered on the vertical axis of the device.

FIG. 7 is an illustration of the top view of an embodiment of the skimmer device. In this view, we can see that there are four floats 113 arranged around the vertical axis of the device. In this embodiment, there is also a cross pipe that can be used as a handle.

Figure 11:
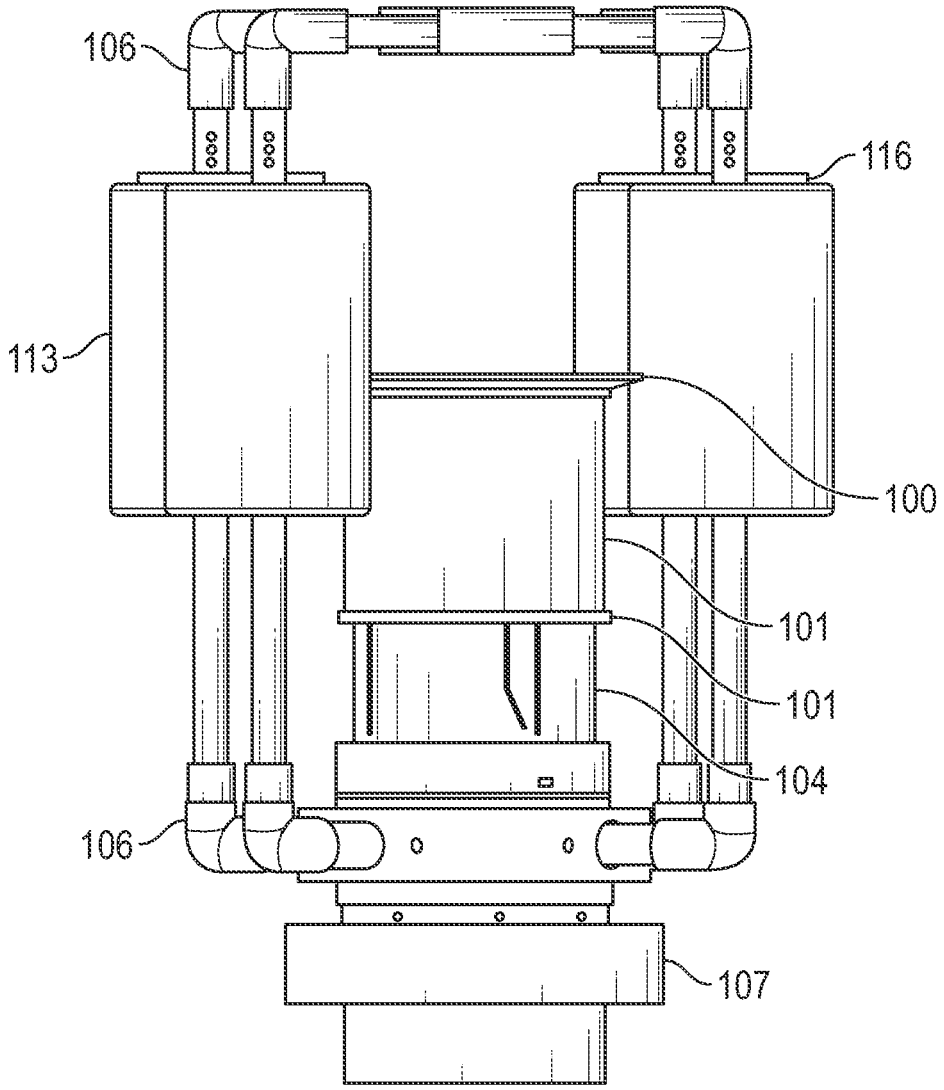
FIG. 11 is a view of an embodiment of the skimmer float harness, floats, funnel, and ballast collar.

FIG. 11 is an illustration of the embodiment of the floats 113, float harness 114, funnel 100 and the ballast collar 107. On the funnel basket holder 104, you can see the grooves in which the funnel ring 102 tabs may ride in. There are two tracks, because one track is used for placing the funnel 100 via the funnel ring 102 onto the funnel basket holder 104. This track has an opening that allows the ring to be placed in the groove and slid down the funnel basket holder 104. When the funnel 100 is at its lowest position, then the funnel 100 can be twisted clockwise so it will now ride in the other groove. This groove has no opening at the top of the funnel basket holder 104, so the funnel is trapped in the groove, in which it can freely float up and down the funnel basket holder 104, but not off the funnel basket holder 104.

FIG. 12 is an illustration of the embodiment of the optional water pump attachment that allows the skimmer device to be independent of the swimming pool's pump and filter. In this configuration, the outlet 111 is removed and replaced with a couple, which could be 2-inch PVC, and the pump unit is attached to the skimmer device. The pump is placed in a housing, which could be fabricated from 6-inch PVC pipe 121 and enclosed with 6-inch PVC caps 109. The pump can be a Johnson 4000 submersible bilge pump or similar, which can pump up to 4000 gallons an hour. Pumps with much higher flow or much lesser flow can also be used, depending on the need. In this embodiment, the exhaust from the pump travels through a vacuum hose 123 to a filter bag 124. There is an adapter 125 that allows the bag to attach to the hose. This configuration allows for the use of fine filters 1 to 50 micron, or more coarse filters 100 to 200 microns. Of course, we are not limited to filter bags or these micron values. We also imagine that canister filters can be used to replace the filter bags. We also imagine that the filters can be housed in different styles, such as ducks, fish, ships, as the filter will simply attach via a standard hose.

The above description relates mostly to the use of the skimmer device in swimming pools. However, the design of this device will allow it to be used in many different bodies of water for many different duties. These include, but are not limited to, the following:

In fishponds to remove surface debris.

In water fountains.

In oceans to rid the ocean or other seas of unwanted contaminants, such as oil or small floating plastics.

In industries to clean retaining ponds.

In all these cases the size of the device may vary. For example, in a fish pond the device may only be a foot in length and have a funnel diameter of a couple of inches or so. In the ocean, the device may be 10 s of feet long and have a funnel diameter of a foot or more. The size of the device is determined by the task that it is to perform and the medium in which it is placed.

The foregoing description details some embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A skimmer system, comprising:

a skimmer device, the skimmer device comprising:

a self-adjusting funnel configured to be beneath a surface of water;

a funnel basket holder operably connected to the self-adjusting funnel; and a funnel sleeve operably connected to the self-adjusting funnel;

a float harness and one or more floats attached to the skimmer device;

a coarse skimmer basket to trap non-fine debris;

a ballast collar; and an exhaust outlet pipe;

wherein the self-adjusting funnel is configured to travel up and down a shaft portion of the funnel basket holder along one or more tracks;

wherein the funnel sleeve is configured to permit the self-adjusting funnel to travel up and down a shaft portion of the funnel basket holder.

2. The system of claim 1, wherein the self-adjusting funnel is configured to place itself between 0 to about 3 inches below the surface of water.

3. The system of claim 1, wherein the funnel self-adjusts to an optimal level under the surface of the water.

4. The system of claim 1, wherein the one or more floats are used to keep the device at the proper depth in the water, as to allow the funnel to raise up out of the water and also position itself just beneath the water.

5. The system of claim 1, wherein the ballast collar is used to keep the device at a proper depth in balance with the one or more floats and the self-adjusting funnel.

6. The system of claim 1, wherein the exhaust outlet pipe allows the device to be connected to a pool's vacuum port of a skimmer suction.

7. A skimmer system, comprising:

a skimmer device, the skimmer device comprising:

a self-adjusting funnel configured to be beneath a surface of water;

a funnel basket holder operably connected to the self-adjusting funnel; and a funnel sleeve operably connected to the self-adjusting funnel;

a float harness and floats attached to a skimmer device;

a coarse skimmer basket;

a ballast collar;

a pump housing;

a pump to pump water through the device; and a filter attachment that allows a use of a filter bag or canister to filter water, wherein the self-adjusting funnel is configured to travel up and down a shaft portion of the funnel basket holder along one or more tracks.

8. The system of claim 7, wherein the self-adjusting funnel is configured to place itself between 0 to about 3 inches beneath the surface of the water.

9. The system of claim 7, wherein the water pump is connected in the same manner as the exhaust outlet pipe, thus allowing for the device to be used with a pool filter system or with the optional water pump and filter.

10. The system of claim 7, wherein the filter bag is attached with an adapter.

* * * * *